US006767415B1

(12) United States Patent
Sardoy et al.

(10) Patent No.: US 6,767,415 B1
(45) Date of Patent: Jul. 27, 2004

(54) PROCESS FOR PRODUCING A THIN SHEET OF ULTRA-LOW-CARBON STEEL FOR THE MANUFACTURE OF DRAWN PRODUCTS FOR PACKAGING AND THIN SHEET OBTAINED

(75) Inventors: Veronique Sardoy, Metz (FR); Gilles Dahmen, Volstroff (FR); Isabelle Poissonnet, Wormhout (FR); Anne Blanchard, Istres (FR); Pascal Choquet, Dunkirk (FR); Bernard Debiesme, Ghyvelde (FR)

(73) Assignee: Sollac, Puteaux (FR)

( * ) Notice: Subject to any disclaimer, the term of this patent is extended or adjusted under 35 U.S.C. 154(b) by 186 days.

(21) Appl. No.: 09/129,238

(22) Filed: Aug. 5, 1998

(30) Foreign Application Priority Data

Aug. 7, 1997 (FR) ..... 97 10155

(51) Int. Cl.[7] ..... C22C 38/04; C22C 38/06; C21D 8/04

(52) U.S. Cl. ..... 148/320; 148/603; 148/651; 148/541; 148/546

(58) Field of Search ..... 148/320, 603, 148/651, 541, 546

(56) References Cited

U.S. PATENT DOCUMENTS 3,404,047 A 10/1968 Goodman et al.

FOREIGN PATENT DOCUMENTS

| | | | |
|---|---|---|---|
| EP | 0 521 808 A | 1/1993 | |
| EP | 556 834 A2 * | 8/1993 | ..... 148/603 |
| EP | 0 659 899 A | 6/1995 | |
| EP | 0 754 770 A | 1/1997 | |
| FR | 2 299 408 A | 8/1976 | |
| WO | WO 96 26295 A | 1/1996 | |

* cited by examiner

*Primary Examiner*—Deborah Yee
(74) *Attorney, Agent, or Firm*—Oblon, Spivak, McClelland, Maier & Neustadt, P.C.

(57) ABSTRACT

A killed and vacuum-degassed very-low-carbon steel containing, by weight, between 0.10 and 0.35% manganese, less than 0.006% nitrogen, less than 0.025% phosphorus, less than 0.020% sulphur, less than 0.020% silicon, at most 0.08% of at least one of the elements copper, nickel and chromium, as well as aluminum. The steel is cast in the form of a slab, the slab is hot rolled in order to obtain a hot-rolled sheet, the hot-rolled sheet is coiled, the hot-rolled sheet is cold rolled in two rolling operations separated by a continuous annealing operation. The steel contains at most 0.006% carbon by weight and 0.010% aluminum and the hot-rolled sheet is coiled at a temperature below 620° C. Preferably, the steel is killed by mixing with a slag containing adjusted amounts of aluminum and of alumina.

12 Claims, 5 Drawing Sheets

Al=2×10$^{-3}$% (GI:10.5-1.0)

Al=8×10$^{-3}$% (GI:10.5-1.0)

Al=24×10$^{-3}$% (GI:10.8-1.0)

Al=37×10$^{-3}$% (GI:11.0-1.4)

Al=64×10$^{-3}$% (GI:11.5-2.0)

PROCESS FOR PRODUCING A THIN SHEET OF ULTRA-LOW-CARBON STEEL FOR THE MANUFACTURE OF DRAWN PRODUCTS FOR PACKAGING AND THIN SHEET OBTAINED

The invention relates to a process for producing a thin sheet of ultra-low-carbon steel for the manufacture of drawn products for packaging, such as cans, and a thin sheet obtained by the process.

In order to manufacture, by drawing, steel packaging products such as cans for foodstuffs or for drinks, blanks are used which are cut from thin sheets whose properties have been tailored to the drawing-type forming process.

The drawing processes used for manufacturing cans for preserved food or for drinks are generally drawing-redrawing (DRD) or drawing and wall ironing (DWI) processes.

In either case, it is known to use thin sheets of very-low-carbon or ultra-low-carbon (ULC) steel whose carbon content by weight is a few thousandths of a per cent and generally less than 8 thousandths of a per cent.

A process is known, for example from FR 95/02208, for producing a thin sheet intended for the manufacture of a can, of the drinks-can type, by drawing and wall ironing using a steel having the following composition by weight:

carbon <0.008%, manganese, between 0.10 and 0.30%, nitrogen <0.006%, aluminum, between 0.01 and 0.06%, phosphorus <0.015%, sulphur <0.020%, silicon <0.020%, at most 0.08% of one or more of the elements copper, nickel and chromium, the balance of the composition consisting of iron and inevitable impurities.

In general, in the case of the manufacture of cans by the drawing-redrawing (DRD) or drawing and wall ironing (DWI) processes, specific mechanical properties and drawability characteristics are required with regard to the thin sheets or to the blanks cut from these sheets which are subjected to the drawing operation.

In particular, the thin sheets must have a low tendency to form ears during drawing and must have very good properties for being able to be drawn by necking.

Good drawability is characterized by a high Lankford coefficient or normal anisotropy coefficient and by a plane anisotropy coefficient EC close to zero.

Furthermore, it is also sought to obtain a microstructure of the steel which is as homogeneous as possible over the width of the sheet and along its edges, so as to obtain homogeneous behaviour of the blanks while they are being drawn. In addition, a microstructure as close as possible to a microstructure containing homogeneous equiaxed grains is desired in the sheet intended for drawing.

Because the thickness of the metal packaging in the finished state may be very small (for example, less than 0.1 mm), it is also necessary to use a sheet free of defects such as inclusions, i.e. a material having the best possible inclusion cleanliness.

The thin steel sheets for manufacturing drawn packages are generally produced from an aluminum-killed vacuum-degassed steel, generally cast continuously in the form of a slab which is then hot rolled so as to obtain a hot-rolled strip which is then cold rolled in two steps separated by a recrystallization annealing step.

The second rolling operation, which is generally carried out on a skin-pass rolling mill, makes it possible to obtain a sheet having the final thickness of the product on which the drawing operation is carried out.

In the case of the manufacture of ultra-low-carbon steels, the steel produced in the metallurgical furnace is subject to vacuum degassing, generally with the injection of oxygen, and is aluminium killed before being cast in a continuous casting plant for producing a slab.

The slab is hot rolled at a temperature above the Ar3 point of the steel in order to obtain a hot-rolled sheet whose thickness is generally less than 3 mm.

Next, the hot-rolled sheet is cold rolled with a reduction ratio generally greater than 80% in order to obtain an intermediate cold-rolled sheet or blank which is then annealed at a temperature below the Ac1 point of the steel before the final skin-pass rolling, the reduction ratio of which depends on the intended application of the sheet.

Vacuum-degassed aluminium-killed ultra-low-carbon steel sheets have suitable characteristics with regard to their drawability, the homogeneity of the microstructure obtained after the manufacturing cycle, and the inclusion cleanliness.

However, the manufacture of novel packages of complex shapes with ever thinner walls requires ever higher properties to be obtained.

A process has been proposed in EP-0,521,808 for producing sheets intended for deep drawing, for example for the manufacture of cans by the DRD process from a converter-smelted steel containing at most 0.015% carbon and less than 0.040% aluminium. The process includes hot rolling. The hot-rolled sheet is coiled at a temperature above 650° C., then cold rolled and finally annealed at a temperature below 700° C. The need to coil at a temperature above 650° C. leads to heterogeneities in the properties of the strip, in the transverse direction and between the ends and the core of the coil. In addition, coiling at a temperature above 650° C. leads to a hot-rolled sheet structure which is not very favourable for obtaining a fine-grained cold-rolled sheet (ASTM index greater than 9).

U.S. Pat. No. 3,404,047 describes a process for manufacturing a sheet for deep drawing having a very low carbon content (C ≦0.004%). This very low carbon content is obtained by carrying out a decarburizing annealing operation on the sheet. Because of the annealing conditions (2 to 20 hours at 715° C.), the grain index of the sheet is very low (6 to 7).

EP-0,659,889 describes a process for manufacturing a cold-rolled sheet containing a very small proportion of carbon (C ≦0.004%) and having a very low aluminium content (between 0.005 and 0.070%). The steel has a niobium content which is greater than 0.001% and which can be as much as 0.018%. Because of the presence of niobium, the recrystallization temperature of the steel, and therefore the temperature of the recrystallization annealing, is substantially higher than in niobium-free steels.

The object of the invention is to provide a process for producing a thin sheet of ultra-low-carbon steel for the manufacture of drawn packaging products, in which process:

a killed and vacuum-degassed steel containing, by weight: between 0.10 and 0.35% manganese, less than 0.006% nitrogen, less than 0.025% phosphorus, less than 0.020% sulphur, less than 0.020% silicon, at most 0.08% of one or more elements from among copper, nickel and chromium, as well as aluminium, the balance of the composition consisting of iron and inevitable impurities, is produced, the steel is cast in the form of a slab, the slab is hot rolled at a temperature above Ar3 in order to obtain a hot-rolled sheet, the hot-rolled sheet is coiled, the hot-rolled sheet is cold rolled into the form of an intermediate cold-rolled sheet, the intermediate cold-rolled sheet is continuously annealed at a temperature below Ac1, and the intermediate cold-rolled sheet is rerolled to a final sheet thickness for drawing, the process according to the invention making it possible to substantially improve the drawability, the inclusion cleanliness and the microstructural homogeneity of the sheet for drawing.

To this end, the steel is produced so as to contain at most 0.006% carbon by weight and 0.010% aluminium by weight and the hot-rolled sheet is coiled at a temperature below 620° C. and preferably between 530° C., and 570° C.

The invention also relates to a production process in which the steel is killed by bringing an unkilled steel obtained by smelting in a m tallurgical furnace into contact with a slab containing, in particular, aluminium and alumina $Al_2O_3$.

The invention also relates to a production process in which the steel is cast in the form of a slab in an inert-gas continuous casting plant.

Finally, the invention also relates to a thin sheet having a homogeneous equiaxed-grain structure with a low inclusion content and having very good drawability characteristics, made of an ultra-low-carbon steel containing less than 0.010% aluminium.

In order to make the invention clearly understood, a description will now be given of several examples of the production of thin sheets according to the invention and of the microstructural characteristics and drawability characteristics of these sheets, with reference to the figures appended hereto.

Figure 1:
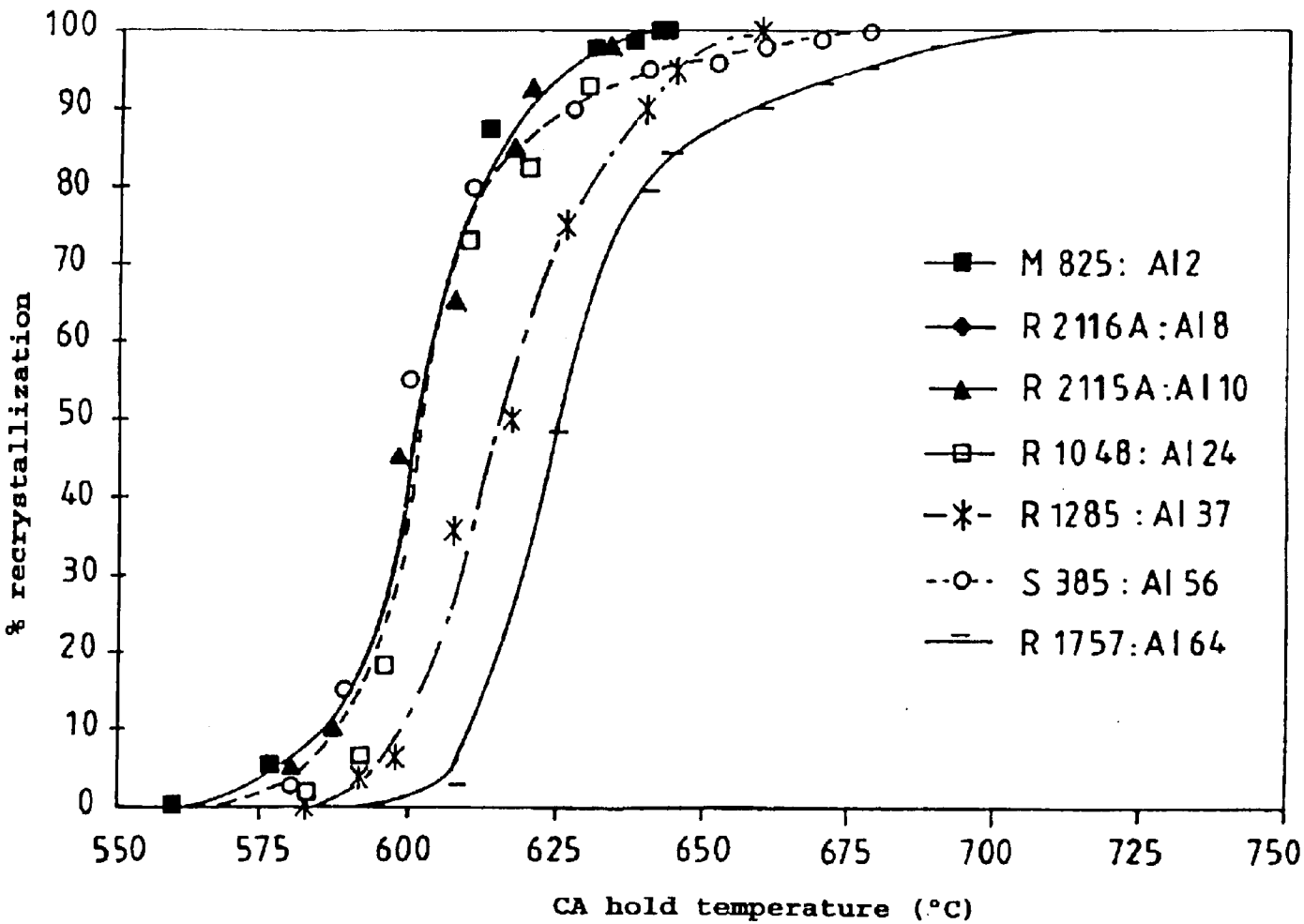
FIG. 1 is a diagram giving the percentage of recrystallization as a function of temperature for steels having different aluminium contents.

In the context of a comparative study between the process for producing drawing sheets according to the invention, which is characterized in particular by very low carbon contents and aluminium contents in the thin sheets obtained, and drawing sheets produced according to the process known from the prior art, these sheets having aluminium contents greater than 0.010% by weight, various steel heats differing substantially only in their aluminium contents were produced. After hot rolling, the sheet is rapidly cooled and coiled at a temperature below 620° C. Table 1 below gives the compositions of the steels used for the manufacture of drawing sheets by cold rolling hot-rolled sheets.

TABLE 1

| Lab. reference | End-of-roll. temp. | Coil temp. | Coil thick. (mm) | C | N | Mn | P | S | Cu | Ni | Cr | Met. Al. | Res. ti (ppm) |
|---|---|---|---|---|---|---|---|---|---|---|---|---|---|
| M825 | 880° C. | 530° C. | 2.72 | 2.7 | 3.4 | 201 | 11 | 5 | 8 | 18 | 14 | 2 | 3 |
| R2116A | 875° C. | 570° C. | 2.96 | 3.5 | 3.5 | 202 | 13 | 11 | 8 | 15 | 15 | 8 | 1 |
| R2115A | 883° C. | 563° C. | 2.95 | 3.2 | 3.5 | 201 | 12 | 11 | 8 | 16 | 16 | 10 | 1 |
| R1048C1 | 894° C. | 560° C. | 3.01 | 2.6 | 2.2 | 201 | 10 | 6 | 6 | 18 | 15 | 24 | 1 |
| R1285 | 900° C. | 590° C. | 3.09 | 3.2 | 2.9 | 198 | 10 | 5 | 11 | 17 | 24 | 37 | 7 |
| S 385 | 881° C. | 579° C. | 2.00 | 2.9 | 3.0 | 197 | 10 | 11 | 11 | 19 | 17 | 56 | 4 |
| R1757A | 871° C. | 559° C. | 3.04 | 3.4 | 5.0 | 237 | 3 | 5 | 14 | 18 | 30 | 64 | 4 |

In Table 1, the weight contents of the various elements are given in thousandths of a per cent, apart from the titanium content which is given in ppm, i.e. in tenths of thousandths of a per cent.

Chemical analyses were carried out on the hot-rolled sheets constituting the product obtained in an intermediate step of the production process.

Indicated in the first column ar the reference numbers of the sheets; these reference numbers will be used to denote the sheets until their final state, i.e. in the state of thin sheets for drawing.

The first three sheets, having the reference numbers M825, R2116A and R2115A, are produced according to the process of the invention and have aluminium contents at most equal to 10 thousandths of a per cent.

The next four sheets indicated in Table 1 are given by way of comparison and relate to sheets produced according to the prior art and containing 24 thousandths of a per cent aluminium or more.

The second column in Table 1 indicates the end-of-rolling temperature and the third column indicates the coiling temperature of the hot-rolled sheet.

The fourth column in the table relates to the thicknesses of the hot-rolled sheets.

The next columns in the table indicate the weight contents of the various elements in the steel of the sheets.

The steels used for producing the hot-rolled sheets are smelted in a metallurgical furnace and then poured into a ladle. The steel is vacuum degassed and killed before being cast in a continuous slab casting plant.

The vacuum degassing of the steel is preferably carried out in an RHOB plant, i.e. by blowing pure oxygen into the moving steel in a vacuum chamber, or in an in-vessel vacuum plant.

The steels for metal packaging are generally killed by adding aluminium to the steel.

Such a process was used in the case of the comparative steels.

Such an aluminium killing process can no longer be applied in the case of steels which contain less than 0.010% aluminium.

In the case of the three steels according to the invention, containing less than 0.010% aluminium, the killing op ration was carried out by a r action between the slag and the steel, during mixing.

However, it is necessary to add a mixture of aluminium and alumina $Al_2O_3$ to the slag in order to prevent the steel from reoxidizing. This is because the slag contains a high proportion of FeO and the aluminium traps the oxygen released by the FeO during mixing.

By adjusting the amounts of aluminium and alumina in the slag, the final aluminium content of the steel may be adjusted to a value of less than 0.010%.

Vacuum degassing, which is a standard technique in the production of ultra-low-carbon steels, makes it possible to obtain a carbon content of less than 0.006%.

In the case of the steels produced, the composition of which is given in Table 1, the carbon contents of these steels are all between 26 and 35 ppm.

So as to allow meaningful comparisons of the mechanical properties of the steels, certain corrections will be made in order to reduce the mechanical properties to a standard carbon content of 25 ppm.

In general, the carbon content of the ultra-low-carbon steels according to the invention is less than 0.006%.

These steels have a nitrogen weight content ranging from 22 to 50 ppm. In general, for the steels intended for the manufacture of thin sheets for packaging, the nitrogen content is always less than 0.006%, or 60 ppm.

Also in such steels, the manganese content is generally between 0.10 and 0.35%. In the case of the steels in Table 1, the manganese contents are between 0.197 and 0.237%. In the steels for thin sheets for metal packaging, the phosphorus content and the sulphur content must be limited to 0.025%, preferably 0.015%, and to 0.020%, respectively. In the case of the steels of the examples in Table 1, these contents are between 0.003 and 0.013% and between 0.005 and 0.011%, respectively.

Likewise, in the steels for metal packaging in the form of thin sheets, the elements such as copper, nickel and chromium must not together be in an amount greater than 0.08%.

In the case of the steels in Table 1, this total copper, nickel and chromium content is at most equal to 0.062%.

Furthermore, it has been possible to show that low contents of titanium and of niobium could significantly increase the complete recrystallization temperature of the sheets.

In order to obtain suitable sheet recrystallization conditions, the titanium content is necessarily limited to 10 ppm and preferably to 6 ppm.

Likewise, niobium must be limited to 10 ppm.

In ultra-low-carbon steels known from the prior art, the metallic aluminium content after producing the sheets is generally greater than 0.010% by weight or 10 thousandths of a per cent, this content generally being between 10 and 60 thousandths of a per cent.

The particular method of producing the steels according to the invention and the desire to have an aluminium content at most equal to 0.010% make it possible to obtain, as will be shown below, sheets having an improved microstructure, a much greater microstructural homogeneity, greater inclusion cleanliness and better drawability characteristics.

In particular, it has been possible to show that the improvement in the microstructure of the sheets, the better microstructural homogeneity and the good drawability characteristics were due to the low residual aluminium content.

The killed steel is vacuum degassed and cast in a continuous slab casting plant in an inert atmosphere.

Casting in an inert atmosphere prevents reoxygenation of the steel during continuous casting and therefore prevents effervescence and break-out phenomena occurring during casting.

The slab cast in the continuous casting plant is hot rolled at a temperature above the Ar3 temperature of the steel.

In the case of the sheets mentioned in Table 1, the second column indicates the end-of-rolling temperature of the hot-rolled sheets.

Next, the hot-rolled sheets are coiled at a temperature below the recrystallization temperature of the steel, and always below 620° C.

Table 2 below gives the microstructural characteristics of the hot-rolled sheets, the compositions and rolling conditions of which are given in Table 1.

TABLE 2

| Reference | GI | E1 | $R_{p0.2,\,T}$ (MPa) | $R_{m,\,T}$ (MPa) | A % | $r_T$ |
|---|---|---|---|---|---|---|
| M825 | 8.5 | 1.0 | 216 | 316 | 40.0 | 1.01 |
| R2116A | 8.7 | 1.0 | 292 | 349 | 29.4 | 0.81 |
| R2115A | 8.2 | 1.0 | 281 | 333 | 33.5 | 0.99 |
| R1049 C1 | 8.2 | 1.0 | 276 | 333 | 35.0 | 0.95 |
| R1295 | 7.0 | 1.0 | 238 | 317 | 36.3 | 0.96 |
| S 385 | 8.0 | 1.0 | 226 | 318 | 36.2 | 0.90 |
| R1757A | 10 | 1.0 | 255 | 342 | 34.7 | 0.84 |

The first column in the table gives the reference numbers of the hot-rolled sheets; the second column gives the grain index of the hot-rolled sheet and the third column the elongation of the grains.

The microstructural characteristics correspond to the central part in the core of the hot-rolled sheets.

It appears that the core microstructure of the various hot-rolled sheets does not seem to be dependent on the aluminium content.

A finer grain (GI=10.0) in the case of the R1757A specimen seems to be due essentially to the presence of larger amounts of nitrogen, manganese, copper and chromium in the alloy. In contrast, the coarser grains (GI=7.0) in the case of the R1285 specimen seem to be related to the rolling having been carried out at a higher temperature (900° C.), resulting in austenitic grain coarsening.

Table 2 also gives, in columns 4, 5, 6 and 7 respectively, the 0.2% yield stress of the sheets in the transverse direction, the tensile strength in the transverse direction, the elongation at break and the standard anisotropy coefficient rT in the transverse direction.

It will be seen that, as the aluminium content of the steel increases, there is an increase in the mechanical properties and a decrease in the elongation as well as a decrease (apart from in the case of the R2116A sheet) in the normal anisotropy coefficient $r_\tau$.

After cooling, the hot-rolled sheets are cold rolled with a reduction ratio of 85 to 95%. Intermediate sheets are thus obtained which have a thickness of about 0.2 to 0.3 mm.

Next, these sheets are annealed in a continuous annealing plant at a temperature below the Ac1 temperature of the steel.

The blank of cold-rolled sheet is then rerolled down to a final sheet thickness for drawing.

The continuous annealing is carried out at a temperature which is generally 20° C. to 30° C. above the recrystallization temperature of the steel; in the case of the process according to the invention, the annealing temperature is at most equal to 700° C.; the heating rate of the sheet is about 27° C. per second. The steel is maintained at the annealing temperature above the recrystallization temperature for a time which is less than 3 minutes and which is generally, for practical reasons, approximately 20 or 30 seconds. After continuous annealing, the sheet is firstly cooled at a rate of about 8° C. per second and secondly at a rate of about 10° C. per second.

Depending on the intended application of the drawing sheets, the steps of cold rolling and of annealing the hot-rolled sheets produced according to the invention are carried out in a different manner.

In the case of sheets intended for forming cans by drawing-r drawing (DRD), the hot-rolled sheet with a thickness of about 2.3 mm is cold rolled with a cold-rolling ratio of 85 to 89%.

Next, the cold-rolled intermediate sheet is continuously annealed at a temperature of approximately 650° C. for a time of about 20 seconds.

The second cold rolling or finish rolling is carried out in a skin-pass mill with a reduction ratio of between 23 and 31%.

In the case of sheets intended for manufacturing drinks cans by drawing and wall ironing (DWI), the hot-rolled sheet with a thickness of about 3 mm is cold rolled with a reduction ratio of 90 to 93%.

An annealing operation is carried out at a temperature of about 670° C. for a time of approximately 30 seconds.

The final skin-pass rolling is carried out with a reduction ratio of 2.5 to 17%.

The high reduction ratio during the final rolling in the case of DRD sheets makes it possible to develop high mechanical properties in the cold-rolled sheets.

Table 3 below gives, in the first column, the reference numbers of the sheets, which correspond to the reference numbers in Tables 1 and 2, the various sheets being differentiated, with regard to their composition, mainly by their aluminium content.

Table 3

See Next Page

The first three sheets have compositions according to the invention while the next four sheets are comparative sheets.

Column 2 in Table 3 gives the reduction ratio of the hot-rolled sheets during a first cold-rolling operation. This cold-rolling operation is followed by a second, skin-pass, cold rolling operation with an identical elongation, of 2.5%, for all the sheets.

The third column gives the continuous annealing temperature (Rc).

TABLE 3

| Reference | CR rad. ratio (%) | RC | Sampl dir. | $R_e$ | $R_o$ | A % | rd | nd | $r_{aver}$ | $n_{aver}$ | ΔC | GI–El |
|---|---|---|---|---|---|---|---|---|---|---|---|---|
| M825 | 89.7 | 670° C. | L | 244 | 347 | 37.6 | 1.85 | 0.207 | 1.82 | 0.200 | 0.10 | 10.5–1.0 |
| 880° C./530° C. | | | L | 240 | 346 | 35.5 | 1.78 | 0.206 | | | | |
| 2.72 mm | | | T | 257 | 347 | 33.2 | 2.33 | 0.194 | | | | |
| | | | T | 246 | 343 | 40.7 | 2.68 | 0.205 | | | | |
| | | | 45 | 250 | 342 | 34.1 | 1.55 | 0.197 | | | | |
| | | | 45 | 257 | 350 | 32.8 | 1.62 | 0.198 | | | | |
| R2116A | 90.0 | 670° C. | L | 285 | 370 | 26.0 | 1.62 | 0.157 | 1.62 | 0.157 | 0.08 | 10.5–1.0 |
| 875° C./570° C. | | | L | 280 | 368 | 26.8 | 1.62 | 0.160 | | | | |
| 2.96 mm | | | T | 289 | 376 | 30.2 | 2.08 | 0.159 | | | | |
| | | | T | 290 | 378 | 27.2 | 2.07 | 0.155 | | | | |
| | | | 45 | 270 | 362 | 29.4 | 1.50 | 0.155 | | | | |
| | | | 45 | 271 | 366 | 30.4 | 1.48 | 0.158 | | | | |
| R2115A | 90.3 | 670° C. | L | 258 | 361 | 26.1 | 1.57 | 0.196 | 1.63 | 0.195 | 0.12 | 10.5–1.0 |
| 883° C./563° C. | | | L | 259 | 359 | 26.6 | 1.59 | 0.197 | | | | |
| 2.95 mm | | | T | 257 | 359 | 28.7 | 2.17 | 0.198 | | | | |
| | | | T | 262 | 359 | 29.6 | 2.17 | 0.198 | | | | |
| | | | 45 | 266 | 360 | 27.0 | 1.39 | 0.192 | | | | |
| | | | 45 | 265 | 360 | 32.8 | 1.51 | 0.195 | | | | |
| R1048 Cl | 91.4 | 670° C. | L | 255 | 352 | 34.3 | 1.53 | 0.201 | 1.54 | 0.199 | 0.07 | 10.5–1.0 |
| 894° C./560° C. | | | L | 255 | 353 | 34.1 | 1.51 | 0.202 | | | | |
| 3.01 mm | | | T | 262 | 351 | 35.6 | 2.05 | 0.192 | | | | |
| | | | T | 260 | 352 | 36.4 | 2.04 | 0.198 | | | | |
| | | | 45 | 256 | 353 | 32.0 | 1.35 | 0.201 | | | | |
| | | | 45 | 256 | 352 | 36.7 | 1.40 | 0.200 | | | | |
| R1285 | 91.9 | 670° C. | L | 267 | 366 | 29.2 | 1.51 | 0.190 | 1.48 | 0.188 | −0.03 | 11.4–1.4 |
| 900° C./590° C. | | | L | 266 | 366 | 28.0 | 1.44 | 0.192 | | | | heterogeneous |
| 3.09 mm | | | T | 271 | 363 | 28.8 | 1.79 | 0.186 | | | | structure |
| | | | T | 268 | 363 | 27.0 | 1.77 | 0.184 | | | | |
| | | | 45 | 267 | 357 | 26.2 | 1.39 | 0.184 | | | | |
| | | | 45 | 265 | 353 | 27.2 | 1.37 | 0.191 | | | | |

TABLE 3-continued

| Reference | CR rad. ratio (%) | RC | Sampl dir. | $R_e$ | $R_o$ | A % | rd | nd | $r_{aver}$ | $n_{aver}$ | ΔC | GI–El |
|---|---|---|---|---|---|---|---|---|---|---|---|---|
| S385 | 91.3 | 700° C. | L | 290 | 368 | 33.2 | 1.57 | 0.165 | 1.68 | 0.161 | −0.03 | 11.4–1.4 |
| 881° C./579° C. | | | L | 288 | 369 | 34.3 | 1.59 | 0.168 | | | | heterogeneous |
| 2.00 mm | | | T | 295 | 369 | 31.6 | 2.12 | 0.157 | | | | structure |
| | | | T | 295 | 368 | 28.8 | 2.04 | 0.150 | | | | |
| | | | 45 | 287 | 363 | 30.2 | 1.50 | 0.163 | | | | |
| | | | 45 | 283 | 361 | 32.4 | 1.67 | 0.159 | | | | |
| R1757A | 91.1 | 700° C. | L | 267 | 366 | 25.5 | 1.40 | 0.190 | 1.46 | 0.184 | −0.08 | highly |
| 871° C./559° C. | | | L | 270 | 366 | 26.2 | 1.42 | 0.189 | | | | elongated |
| 3.04 mm | | | T | 275 | 363 | 26.5 | 1.85 | 0.176 | | | | very |
| | | | T | 278 | 366 | 24.7 | 1.81 | 0.177 | | | | heterogeneous |
| | | | 45 | 272 | 355 | 26.9 | 1.35 | 0.186 | | | | structure |
| | | | 45 | 273 | 355 | 27.3 | 1.44 | 0.185 | | | | |

Next, a series of mechanical properties were measured on the sheets after the final skin-pass rolling, as will be indicated below.

The reduction ratio during the first cold rolling operation, which is about 90% or slightly higher, and the reduction ratio during the second cold rolling operation, which is about 2.5%, are characteristics of DWI sheet production.

Test samples were removed from the sheets obtained after the final skin-pass rolling, the sampling direction of the test pieces being given in the fourth column of Table 3 (L: in the length direction of the sheet, T: in the transverse direction, 45: at 45°).

The next columns in Table 3 give the measured values of the yield stress $R_s$, the tensile strength $R_m$, the elongation A%, the Lankford coefficient rd and the parameter nd for each of the test pieces taken from the sheets.

Indicated in the next columns are the average Lankford coefficient $r_{aver}$ and the parameter $n_{aver}$ for the entire sheet.

The next column gives the measured plane anisotropy coefficient ΔC which, as may be seen, is close to zero.

The final column gives the grain characteristics in the form of the grain index GI and the grain elongation El.

The measured results given in Table 3 will be commented on subsequently with regard to FIGS. 3 to 6 in which the results have been plotted in the form of graphs.

A first objective of the study made on the sheets, whose reference numbers are given in Table 3, was to determine the influence of the aluminium content of the sheets on the recrystallization temperature and on the recrystallization microstructure obtained in the sheets after the final cold-rolling operation.

Between the two cold sheet rolling operations, various continuous-annealing simulations were made on specimens of the ah eta in order to determin the amount of recrystallization as a function of the continuous-annealing hold temperature for the various sheets, the compositions of which are given in Table 1.

The results are given in FIG. 1, in which the recrystallization curves have been plotted for each of the sheet compositions, the first three sheets having compositions corresponding to the process according to the invention and the next four being comparative sheets.

The hold time at the annealing temperature is in all cases 30 seconds.

The three sheets according to the invention have virtually the same recrystallization curve, plotted by the solid line in FIG. 1.

Complete recrystallization annealing is obtained at 640° C.

The R1285 sheet containing 37 thousandths of a per cent aluminium, the recrystallization curve of which is indicated by the dot-dash line, shows a complete recrystallization temperature of about 660° C.

The S 385 sheet containing 56 thousandths of a per cent aluminium has a complete recrystallization temperature of about 680° C. and the R1757 sheet containing 64 thousandths of a per cent aluminium has a complete recrystallization temperature of 710° C.

A 40° shift in the recrystallization temperature of the sheets is therefore observed when the aluminium content goes from contents corresponding to the process for producing sheets according to the invention to a sheet containing 64 thousandths of a per cent aluminium. In the case of the sheets containing 37 and 56 thousandths of a per cent aluminium, respectively, the shift is approximately 20° C. and 40° C., respectively.

With regard to the R1048 sheet containing 24 thousandths of a per cent aluminium, the shift in the recrystallization temperature is less than 20° C.

FIGS. 2A, 2B, 2C, 2D and 2E are micrographs at a magnification of 290 showing the grains of sheets according to the invention after the annealing.

Figure 2A:
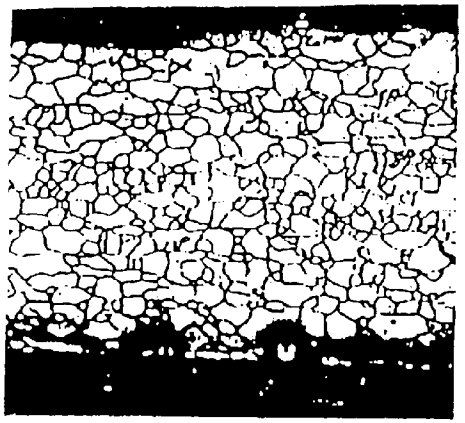
FIGS. 2A, 2B, 2C, 2D and 2E are microstructures, after recrystallization, of cold-rolled steel sheets having different aluminium contents, these increasing from FIG. 2A to FIG. 2E.

FIG. 2A shows the microstructure of a cold-rolled sheet whose aluminium content is 2 thousandths of a per cent, this sheet corresponding to the M825 sheet in Tables 1, 2 and 3. The grains in the sheet are of uniform shape and are equiaxed and the grain index is 10.5 with a grain elongation of 1.

Figure 2B:
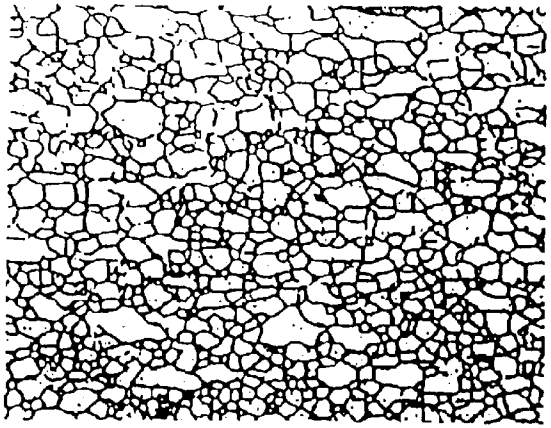

FIG. 2B is a micrograph showing the grains in a sheet containing 8 thousandths of a per cent aluminium, which corresponds to the R2116A sheet in the tables. The grains in the sheet are equiaxed and have a homogeneous structure and homogeneous size. The grain index and the grain elongation are identical to the case in FIG. 2A.

Figure 2C:
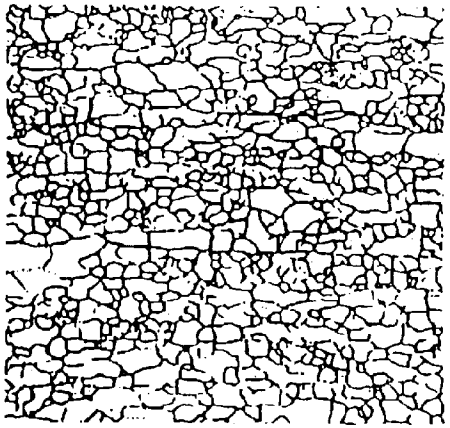

FIG. 2C is a micrograph of a sheet containing 24 thousandths of a per cent aluminium, which corresponds to the R1048 C1 sheet mentioned in the tables.

The grains in the sheet are no longer of homogeneous size and of purely equiaxed structure.

The grain index GI is 10.8 and the grain elongation is 1.0.

Figure 2D:
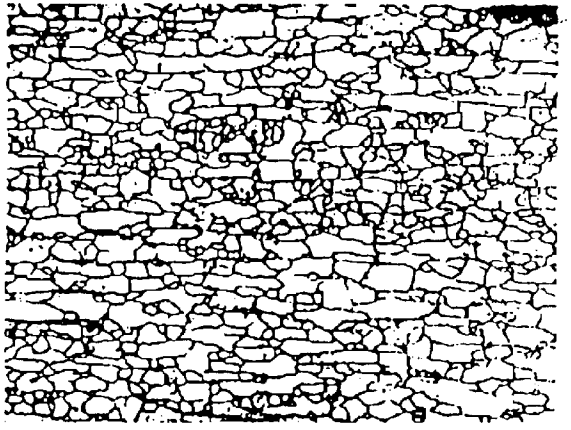
Figure 2E:
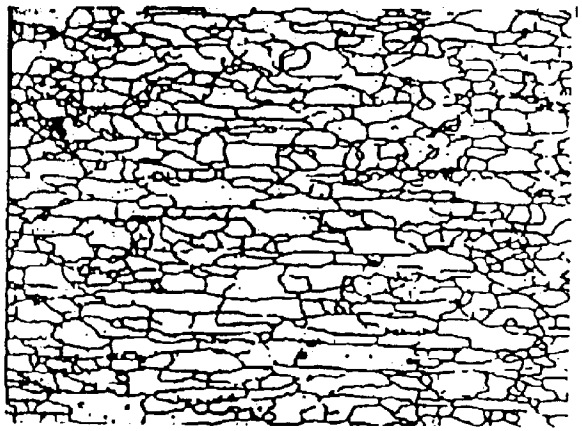

FIGS. 2D and 2E are micrographs of sheets containing 37 and 64 thousandths of a per cent aluminium, respectively, these sheets corresponding to the R1285 and R1757A sheets in the tables.

The grains no longer have an equiaxed structure but an irregular and elongate structure known by the name "pancake" structure.

The grain indices are 11 and 11.5 and the grain elongations are 1.4 and 2, respectively.

It is therefore apparent that for aluminium contents of 2 and 8, i.e. for sheets produced according to the process of the invention, the grains are homogeneous and of equiaxed shape, which presages uniform drawing behaviour and a reduced risk of defects such as drawing ears.

In contrast, in the case of the sheets produced according to the process of the prior art with an aluminium content greater than 10 thousandths of a per cent, the grains are no longer homog neous and equiaxed, which would suggest inferior drawing behaviour.

In addition, a low aluminium content, of less than 10 thousandths of a per cent, makes it possible to obtain good microstructural homogeneity in the longitudinal and transverse directions.

Figure 3:
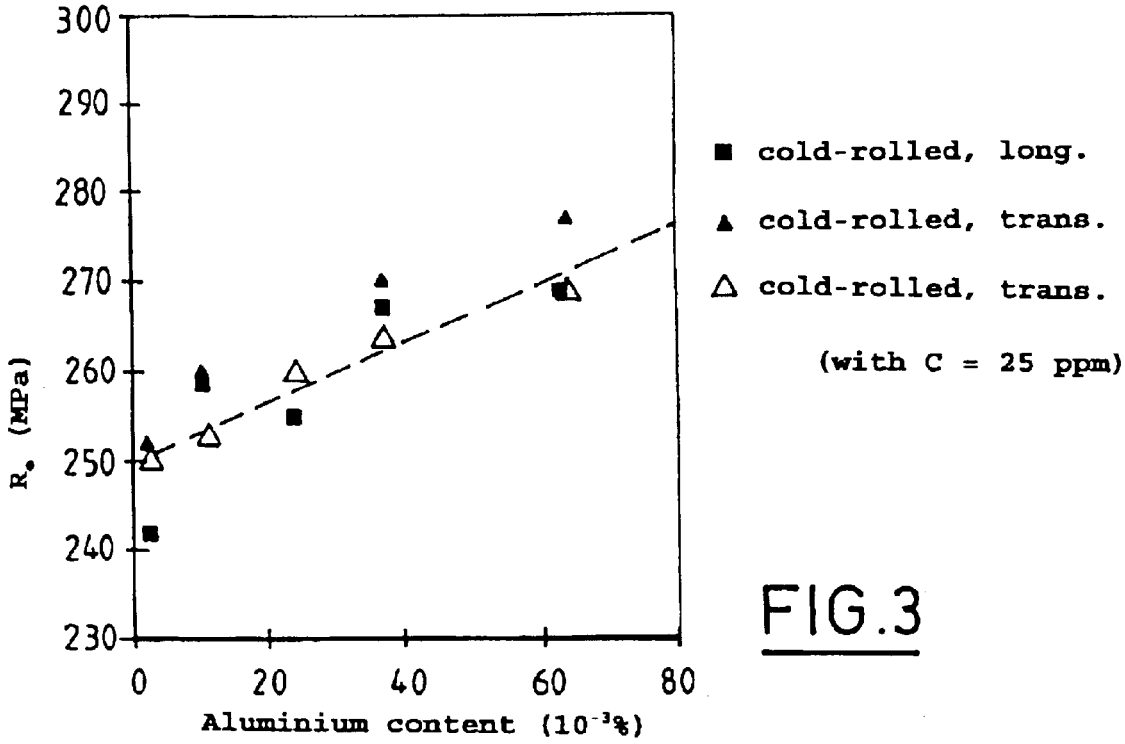
FIG. 3 is a diagram giving the yield stress as a function of the aluminium content of steel sheets for drawing which are produced according to the invention and, by way of comparison, according to the prior art.
Figure 4:
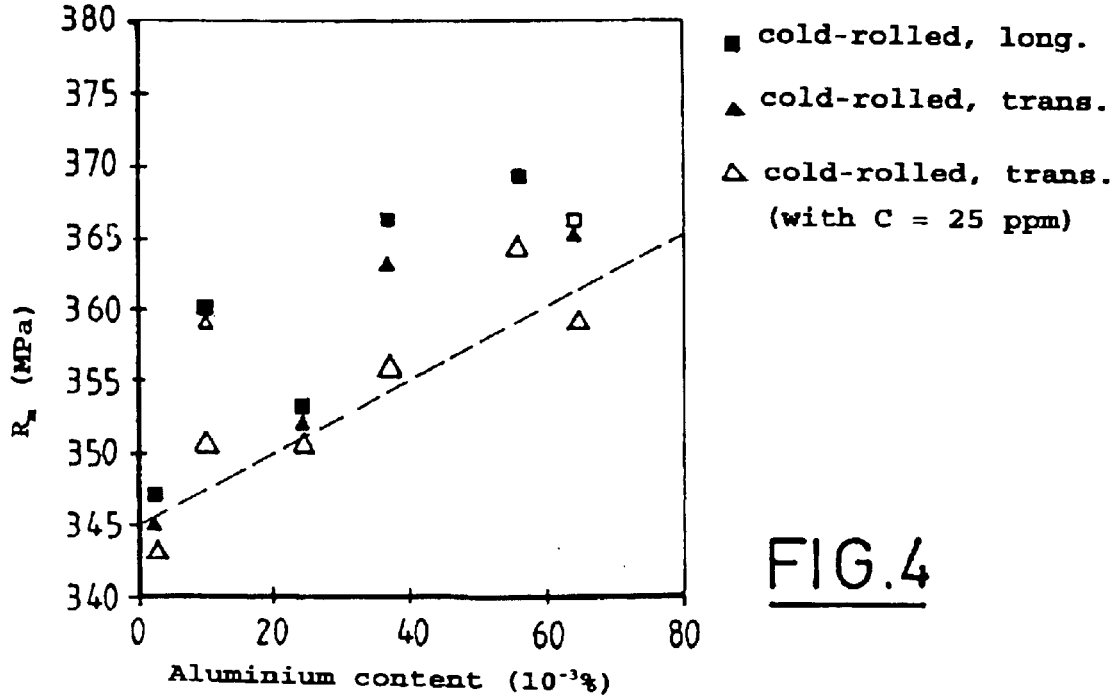
FIG. 4 is a diagram giving the tensile strength as a function of the aluminium content of steel drawing sheets produced by the process according to the invention and, by way of comparison, of steel sheets produced according to the process known from the prior art.

The mechanical properties given in Table 3 are plotted in FIGS. 3 and 4 in the form of diagrams giving the yield stress $R_s$ and the tensile strength $R_m$ in MPa as a function of the aluminium content.

Most of the points relating to the measurements of the yield stress and the mechanical strength in the longitudinal direction and in the transverse direction fall on straight lines which have been plotted as the dotted lines in FIGS. 3 and 4. In general, the yield stress $R_s$ and the tensile strength $R_m$ increase with the aluminium content.

In the case of the steels produced according to the process of the invention, the yield stress and the tensile strength reduced to a 25 ppm carbon content are slightly greater than 250 and 345 MPa, respectively.

Figure 5A:
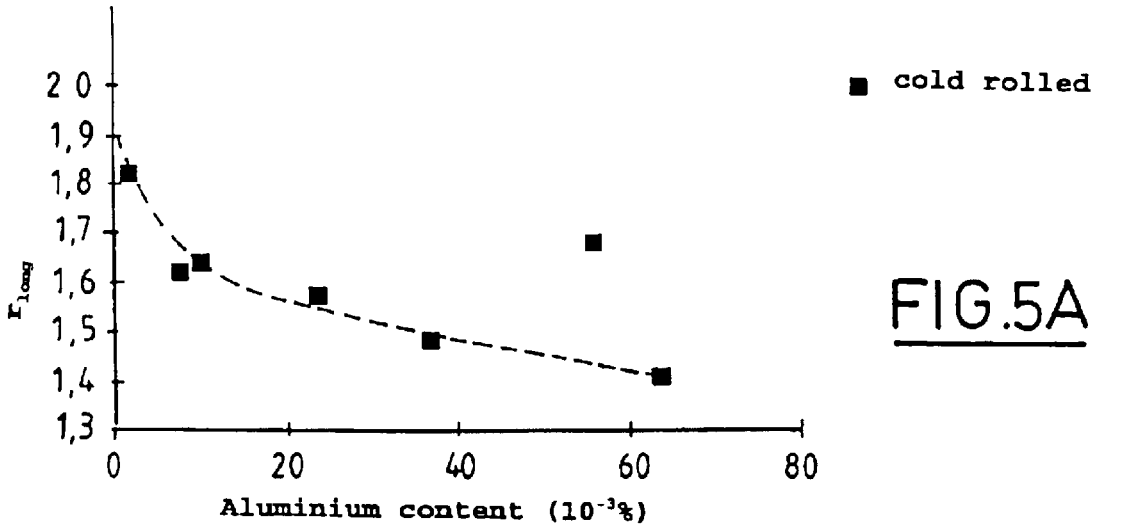
FIGS. 5A, 5B and 5C are diagrams showing the anisotropy coefficient r of a drawing sheet according to the invention in the longitudinal direction of the sheet, in the transverse direction and at 45°, respectively.
Figure 5B:
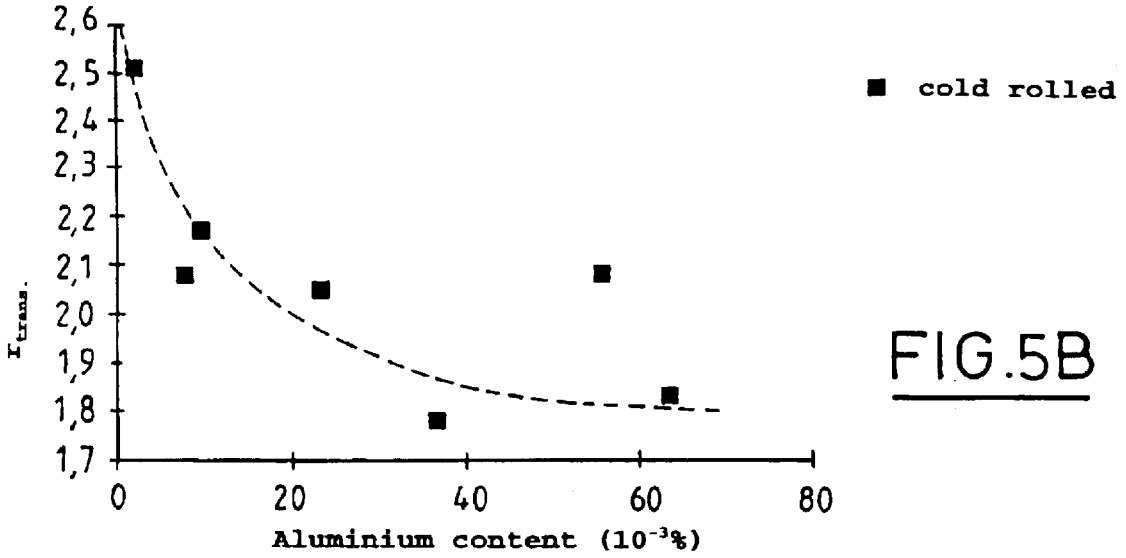
Figure 5C:
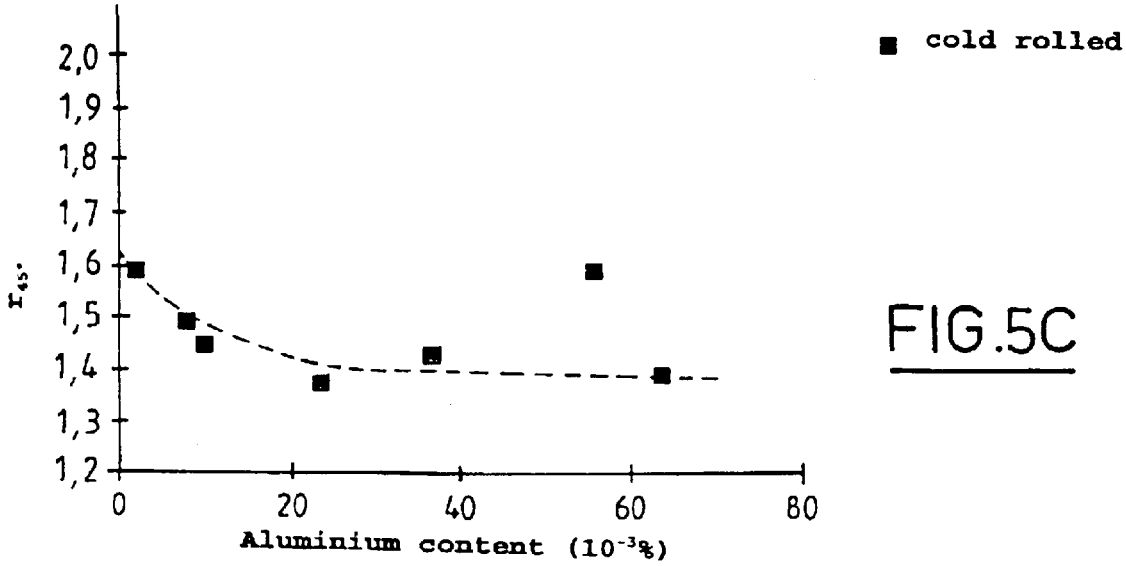

FIGS. 5A, 5B and 5C show variations in the Lankford coefficients in the longitudinal direction, in the transverse direction and at 45°.

A Lankford coefficient of high value is indicative of a high standard anisotropy conducive to drawing.

As may be seen in the curves in FIGS. 5A, 5B and 5C, whatever the sampling direction of the test pieces, the Lankford coefficient r is high for aluminium contents close to zero and then decreases before stabilizing at a minimum value for the highest aluminium contents.

Figure 6:
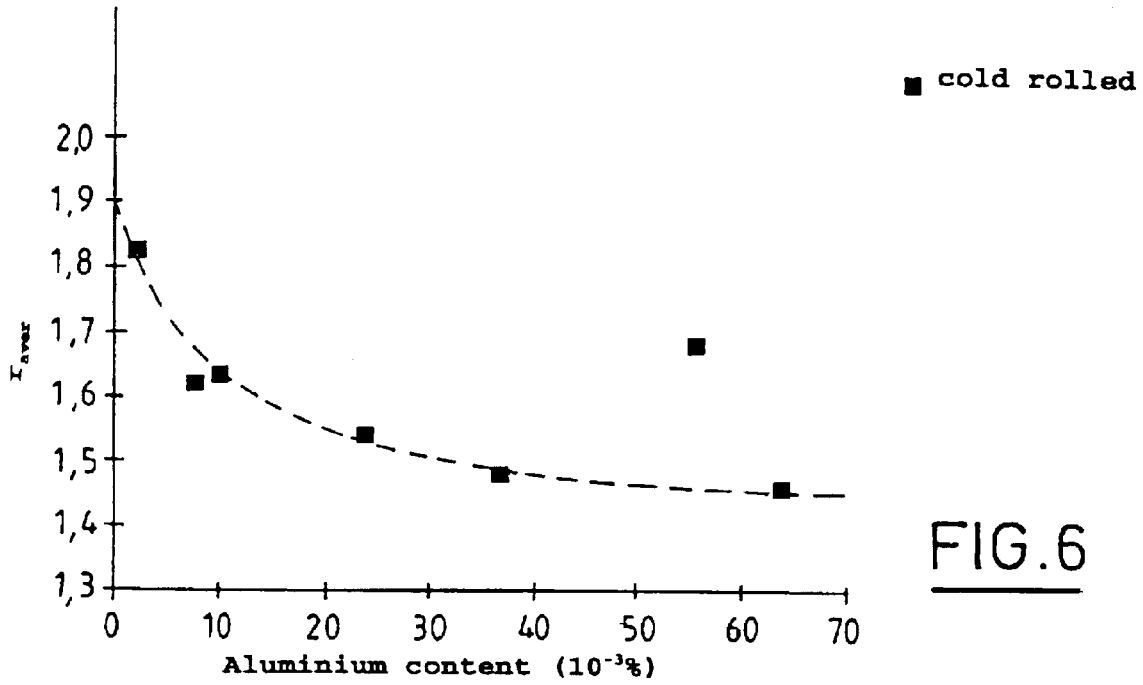
FIG. 6 is a diagram giving the average anisotropy coefficient r as a function of the aluminium content of steel drawing sheets produced according to the invention and, by way of comparison, produced according to the prior art.

FIG. 6 shows the average Lankford coefficient for the entire sheet, $r_{aver}$, as a function of the aluminium content.

By plotting the curve passing through the measurement points, it may be seen that the value of the coefficient $r_{aver}$ extrapolated to 0% aluminium is about 1.9 and that, for an aluminium content of 10 thousandths of a per cent, the value of the Lankford coefficient is slightly greater than 1.60 (1.63).

It is assumed that a value of the average Lankford coefficient greater than 1.6 enables the necking drawability to be improved.

Above 10 thousandths of a per cent aluminium in the steel sheets, the average Lankford coefficient very rapidly falls below 1.6 before stabilizing at around 1.45 in the case of the highest aluminium contents of the sheet specimens on which the tests were carried out.

TABLE 4

| Steel | C | Mn | Al | N | HR $T_{fin}$ | $T_{coil}$ | CR rad. ratio | $T_{anneal}$ | r | ΔC | GI |
|---|---|---|---|---|---|---|---|---|---|---|---|
| A | 7 | 188 | 15 | 4.7 | 870 | 620 | 90.1 | 650° C. 30 s | 1.40 | −0.35 | 11.6 |
| B | 8 | 199 | 13 | 4.3 | 870 | 715 | 89.7 | 650° C. 30 s | 1.60 | −0.20 | 10 |
| C | 3.2 | 201 | 10 | 3.5 | 883 | 563 | 90.3 | 670° C. 30 s | 1.68 | 0.12 | 10.5 |
| D | 5.3 | 200 | 12 | 5.6 | 865 | 670 | 89.5 | 670° C. 30 s | 1.65 | −0.02 | 9 |
| E | 5.8 | 209 | 12 | 4.9 | 865 | 540 | 90.0 | 670° C. 30 s | 1.63 | −0.07 | 10.7 |
| F | 12 | 204 | 12 | 5.5 | 872 | 590 | 90.2 | 650° C. 30 s | 1.30 | −0.38 | 11.3 |
| G | 13 | 187 | 6 | 4.8 | 869 | 595 | 89.9 | 650° C. 30 s | 1.35 | −0.36 | 10.8 |
| H | 12 | 204 | 12 | 5.5 | 874 | 700 | 90.1 | 650° C. 30 s | 1.50 | −0.20 | 10.3 |
| I | 13 | 187 | 6 | 4.8 | 872 | 695 | 90.0 | 650° C. 30 s | 1.55 | −0.20 | 9.1 |
| J | 3.5 | 202 | 8 | 3.5 | 875 | 698 | 89.8 | 670° C. 30 s | 1.69 | 0.04 | 9 |
| K | 2.7 | 204 | 33 | 2.3 | 868 | 555 | 89.9 | 650° C. 8 h | 1.88 | 0.24 | 7 |
| L | 2.7 | 204 | 33 | 2.3 | 868 | 555 | 91.1 | 670° C. 30 s | 1.66 | 0.06 | 11 |

Table 4 gives the compositions, rolling, coiling and annealing temperatures and the characteristics r, ΔC and GI relating to drawability for sheets constituting comparative examples with respect to the sheets according to the invention featuring in the first part of Table 3 above.

The steels of the comparative examples, the reference numbers of which are given in the first column in Table 4, apart from steel C, which corresponds to steel R2115A according to the invention shown in Table 3, have compositions which differ from the composition of a steel according to the invention, either by their carbon content (steels G and I) or by their aluminium content (steels D, E, J, K and L), or else by both their carbon content and their aluminium content (steels A, B, F and H).

In addition, the sheets having the compositions B, D, H, I and J were coiled, after hot rolling at a temperature above 620° C., which is the upper limit of the coiling temperature in the case of the invention.

The sheets of the comparative examples given in Table 4 have drawability characteristics which are generally inferior to the drawability characteristics of the steels of the invention. Furthermore, these steels, when they have aluminium contents greater than 10 thousandths of a per cent, exhibit a structural homogeneity and an inclusion cleanliness which are inferior to the steels of the invention.

By comparing the characteristics of the sheet of Example C according to the invention with Example J, which has a composition according to the invention and which was obtained by a process in which the hot-rolled sheet was coiled at a temperature above 620° C. (namely 698° C.), it is apparent that the sheets obtained have Lankford coefficients r which are very similar and substantially greater than 1.60 and ΔC values close to 0. However, the ASTM grain index GI of the sheet according to Example J is less than the grain index of the sheet according to Example C and less than 10. The final grains in the sheet are therefore not as fine in the case in which the sheet was coiled at a higher temperature.

In the case of the sheet of Example A, the steel has a carbon content (70 ppm) which is greater than the 60 ppm limit of the sheets produced according to the invention and the hot-rolled sheet is coiled at 620° C., i.e. at the upper limit of the coiling temperature range according to the invention. The Lankford coefficient r is low (only 1.40). The anisotropy coefficient ΔC is very different from 0 (namely −0.35). However, the grain size index (11.6) is quite satisfactory.

In the case of the sheet of Example B, the composition of which is close to that of the steel according to Example A, the coiling temperature is 715° C., i.e. a temperature substantially greater than the 620° C. limit. Sheet B has a relatively satisfactory Lankford coefficient (1.60), an anisotropy coefficient quite far from 0 (namely −0.20) and a grain index less than the grain index in the case of sheet A.

In the case of the sheet of Example D, compared with Example E, steels D and E being steels containing 53 and 58 ppm carbon, respectively, the increase in the coiling temperature above 620° C. (670° C.) has virtually no effect on the Lankford coefficient and on the anisotropy coefficient. On the other hand, the grain index goes from 10.7 to 9 when the coiling temperature goes from 540° C. (Example E) to 670° C. (Example D).

In the case of Examples H and I, a carbon content substantially greater than 6 thousandths of a per cent (12 and 13 thousandths of a per cent) results, in the sheet obtained, in a low Lankford coefficient and an anisotropy coefficient ΔC far from zero. In the case of Examples F and G, the compositions of steels F and G being identical to the compositions of alloys H and I, respectively, the coiling temperatures of the hot-rolled sheet are below 620° C., the r and ΔC characteristics are very poor but the grain index is satisfactory and more favourable than in the case of Examples H and I in which the hot-rolled sheet was coiled at temperatures of about 700° C.

In the case of all the sheets of the examples mentioned above, a recrystallization annealing operation is carried out continuously, for a time of about 30 seconds, at a temperature of about 650° C. or slightly higher.

These comparative examples show that, on the one hand, a carbon content of less than 6 thousandths of a per cent (or 60 ppm) is necessary in the composition of the steel in order to obtain a sheet having satisfactory r and ΔC characteristics. Moreover, these examples also show that, in the case of a carbon content of less than 6 thousandths of a per cent, a moderate coiling temperature, generally below 620° C., makes it possible to obtain a satisfactory grain index which is generally greater than 10, i.e. a fine-grained sheet.

In general, the coiling will be carried out at a temperature of between 450° C. and 620° C. and preferably between 530 and 570° C., as is apparent in particular from Table 1, if the first three examples in the table, which are examples of steels according to the invention, are considered.

If a steel having a carbon content greater than 60 ppm is used, Example B in Table 4 shows that relatively satisfactory r and ΔC characteristics may be obtained by coiling the hot-rolled sheet at a temperature of about 715° C. However, the grain index is then only 10 whereas it was 11.6 in the case of the steel of Example A.

In the context of the process according to the invention, in order to obtain a fine-grained sheet having good drawability characteristics, a steel is produced whose carbon content is less than 60 ppm and the coiling temperature of the hot-rolled sheet is limited to a range of between 450° C. and 620° C., after rapidly cooling the hot-rolled sheet.

It was shown earlier that, in the case of a steel having a carbon content of less than 60 ppm, lowering the aluminium content to below 10 thousandths of a per cent made it possible to obtain very good drawability characteristics, in addition to great structural homogeneity and very good inclusion cleanliness.

Comparing the Examples in Table 4, F and G on the one hand and H and I on the other hand, it may be seen that lowering the aluminium content from 12 to 6 thousandths of a per cent has virtually no effect on the r and ΔC parameters, the values of which remain quite poor in the case of the steels containing 12 and 13 thousandths of a per cent carbon. This effect is almost identical whatever the coiling temperature of the hot-rolled sheet.

In contrast, in the context of the invention, when the carbon content is less than 6 thousandths of a per cent in the steel, lowering the aluminium content below 10 thousandths of a per cent makes it possible to improve the r and ΔC parameters significantly.

The drawing sheets according to the invention must have sufficiently fine grains (grain index at least equal to 9) and a homogeneous structure.

In order to obtain this result, the sheet is rapidly cooled between the temperature at the end of hot rolling and the coiling temperature, which must be below 620° C. This rapid cooling and the coiling at a relatively low temperature make it possible to limit grain growth in the hot-rolled sheet and to obtain a good grain index in the final sheet obtained after cold rolling.

As is apparent from Table 4 (Example K), an ultra-low-carbon and ultra-low-aluminium steel obtained by vacuum degassing in the steelworks, which is annealed at 650° C. for eight hours, has a high Lankford coefficient r (1.88), an anisotropy coefficient substantially different from 0 (0.24) and a very low grain index (GI=7).

When the same steel is used for manufacturing a sheet which is continuously annealed at 670° C. for 30 seconds (Example L), the r and ΔC coefficients as well as the grain index have satisfactory values, although the aluminium content of the steel is substantially greater than the limit given in the case of the invention. However, in this case it is not possible to guarantee very good structural homogeneity and very good inclusion cleanliness.

In the case of ultra-low-carbon steels, as shown by Examples K and L, it is preferable to anneal continuously at a temperature slightly above 650° C., for example 670° C., for a time of 30 seconds. Annealing at these temperatures for a long time results, in addition to increasing the production cost of the sheets, in a degradation in the anisotropy coefficient ΔC and in the grain index.

As may be seen in Table 1, the steels used in the context of the invention contain very small amounts of titanium, of about 1 to a few ppm. It has also been shown that the titanium content is limited to 10 ppm, and preferably to 6 ppm, in the steel so as to avoid increasing the recrystallization temperature of the steel.

It has been demonstrated that, for a titanium content of 10 ppm, the recrystallization temperature is 670° C., instead of 640° C. in the case of a substantially zero titanium content. Because the annealing has to be carried out at 20° C. or 30° C. above the recrystallization temperature of the steel, the titanium content must not exceed 10 ppm in order to have an annealing temperature of at most 700° C. Furthermore, titanium, in an amount greater than 10 ppm, shifts the anisotropy coefficient ΔC with respect to the zero value.

Likewise, niobium increases the recrystallization temperature of the steel in amounts substantially similar to titanium. For a niobium content of 3 ppm, the recrystallization temperature of the steel is equal to 640° C. while in the case of 10 ppm of niobium it is 680° C. The niobium content is therefore limited to 10 ppm in order to limit the annealing temperature of the steel to a value close to 700° C., while at the same time ensuring complete recrystallization throughout the coil of sheet.

The steels used in the context of the invention are therefore steels substantially free of titanium and of niobium, the contents of these elements being limited to 10 ppm, i.e. 0.001% by weight.

The drawing sheets obtained by the production process according to the invention, which in particular have a carbon content at most equal to 6 thousandths of a per cent and an aluminium content at most equal to 10 thousandths of a per cent, have, after the final cold rolling, a homogeneous microstructure containing equiaxed grains and very good drawability characteristics. In particular, the microstructure of the sheet is very homogeneous in the transverse direction and the edges of the sheet have homogeneous equiaxed grains, the size of which is slightly greater than the size of the grains in that part of the strip near the axis. In addition, studies have shown that the sheets obtained by the process of the invention exhibit very good inclusion cleanliness when deoxidation is carried out by slag and when a continuous casting is carried out under inert conditions.

In particular, slag reduction has an effect on the mean square deviation of the inclusion sizes and on the number of inclusions in the steel. Furthermore, the very low aluminium content decreases the average density of inclusions in the steel.

Very good inclusion cleanliness is of great value, in particular in the case of very thin sheets used for the manufacture of metal packages, such as drinks cans, by drawing.

The production process according to the invention makes it possible to decrease the amount of scrap due to heterogeneous microstructures or to the presence of unacceptable inclusions in sheets for drawing, and in particular in DWI-sheets for drawing and wall ironing.

Furthermore, the process according to the invention, which uses very small amounts of aluminium for killing the steel, allows savings to be made in the purchase of aluminium in the context of the production of sheets for drawing.

The invention is not limited to the embodiment which has been described.

Thus, the killing of the steel may be carried out other than by slag reduction and the presence of aluminium in the steel of drawing sheets with a content of less than 10 thousandths of a per cent makes it possible in itself to obtain substantial advantages with regard to the microstructure, the homogeneity and the drawability of the steel sheet.

The invention applies equally well to DRD drawing sheets as to DWI, drawing sheets. The rolling ratios during the first and second cold-rolling operations may be adapted to the use of the sheet for the production of specific drawn packaging products.

What is claimed is:

1. Process for producing a thin sheet of ultra-low-carbon steel, said process comprising:

producing a killed and vacuum-degassed steel comprising, by weight, between 0.10 and 0.35% manganese, less than 0.006% nitrogen, less than 0.025% phosphorus, less than 0.020% sulphur, less than 0.020% silicon, a total amount of the elements copper, nickel and chromium of at most 0.08%, at most 0.006% carbon and at most 0.010% aluminum, iron and inevitable impurities, casting the steel in the form of a slab, hot-rolling the slab at a temperature above Ar3 to obtain a strip of hot-rolled sheet, coiling the hot-rolled sheet, cold-rolling the hot-rolled sheet into the form of an intermediate cold-rolled sheet, continuously annealing the intermediate cold-rolled sheet at a temperature between 640° C. and 670° C., rerolling the intermediate cold-rolled sheet down to a final sheet thickness for drawing, wherein said hot-rolled sheet is coiled at a temperature between greater than 530° C. to 570° C., and wherein said process provides a sheet of ultra-low-carbon steel comprising at most 0.001% titanium and at most 0.001% niobium and having a Lankford coefficient $r_{aver}$ greater than 1.6.

2. Process according to claim 1, wherein the steel comprises at most 0.001% titanium by weight and at most 0.001% niobium by weight and wherein the cold-rolled sheet is annealed at a temperature 640° C. and 670° C. for a time of less than 3 minutes.

3. Process according to claim 2, wherein the hot-rolled sheet has a thickness of about 2.3 mm, the hot-rolled sheet is rolled with a reduction ratio of between 85 and 89%, the cold-rolled intermediate sheet is annealed by continuous annealing at a temperature of approximately 650° C., for approximately twenty seconds, and the cold-rolled intermediate sheet is rerolled in a skin-pass rolling mill with a reduction ratio of between 23 and 31%.

4. Process according to claim 2, wherein the hot-rolled sheet has a thickness of about 3 mm, the hot-rolled sheet is cold rolled with a reduction ratio of 90 to 93%, the intermediate cold-rolled sheet is continuously annealed at a temperature of 670° C. for a time of about thirty seconds and, after annealing, the intermediate sheet is rerolled in a skin-pass rolling mill with a reduction ratio of between 2.5 and 17%.

5. Process according to claim 1, wherein the steel is killed in contact with a slag having an adjusted amount of aluminum and of alumina.

6. Process according to claim 5, wherein the steel is cast in the form of a slab in a inert-atmosphere continuous casting plant.

7. A thin sheet of ultra-low-carbon steel made by the process of claim 1 comprising, by weight, between 0.10 and 0.35% manganese, less than 0.006% nitrogen, less than 0.025% phosphorus, less than 0.020% sulphur, less than 0.020% silicon, a total amount of the elements copper, nickel and chromium of at most 0.08%, at most 0.006% carbon and at most 0.010% aluminum, iron and inevitable impurities, wherein it has a homogeneous structure with equiaxed grains, a Lankford coefficient ($r_{aver}$) greater than 1.6 and a plane anisotropy coefficient ($\Delta C$) close to 0, and wherein said sheet comprises at most 0.001% titanium and 0.001% niobium.

8. Process according to claim 2, wherein the steel is killed in contact with a slag having an adjusted amount of aluminum and of alumina.

9. Process according to claim 3, wherein the steel is killed in contact with a slag having an adjusted amount of aluminum and of alumina.

10. Process according to claim 4, wherein the steel is killed in contact with a slag having an adjusted amount of aluminum and alumina.

11. The process of claim 1, wherein said steel comprises 0.0022–0.0050% nitrogen.

12. The thin sheet as claimed in claim 7, wherein the plane anisotropy cofficient is 0.08–0.12.

* * * * *